United States Patent [19]

Stewart

[11] 4,394,005

[45] Jul. 19, 1983

[54] COLLAPSIBLE TRAFFIC BARRICADE

[76] Inventor: James B. Stewart, 436 Smith St., Marion, Ohio 43302

[21] Appl. No.: 267,171

[22] Filed: May 26, 1981

[51] Int. Cl.[3] ..... E04H 17/14; E01F 13/00; E04G 1/00; E04G 1/32

[52] U.S. Cl. ..... 256/64; 404/6; 182/185; 182/226

[58] Field of Search ..... 256/1, 13.1, 59, 64; 404/6; 182/5, 6, 7, 185, 186, 224, 184, 226; 116/63; 40/606, 607, 610–612

[56] References Cited

U.S. PATENT DOCUMENTS

| | | | |
|---|---|---|---|
| 1,687,820 | 10/1928 | Acker | 256/64 |
| 1,710,644 | 4/1929 | Hilton | 182/184 |
| 3,212,606 | 10/1965 | Spaw | 182/226 |
| 4,231,676 | 11/1980 | Smith et al. | 404/6 |
| 4,248,326 | 2/1981 | Hansen et al. | 182/226 X |

*Primary Examiner*—Richard J. Scanlan, Jr.
*Attorney, Agent, or Firm*—John L. Gray

[57] ABSTRACT

Collapsible traffic barricade is described, having a reflective panel mounted on a pair of leg supports which have vertical portions to receive the reflective panel but are angled outwardly so as to provide greater lateral stability. The supports may also be provided with additional mountings capable of receiving additional reflective panels.

2 Claims, 4 Drawing Figures

COLLAPSIBLE TRAFFIC BARRICADE

BACKGROUND OF THE INVENTION

Conventional traffic barricades usually are made of wood and have the disadvantage of instability due to wind and also will tend to split, chip, and otherwise deteriorate through constant usage, because the supports cut into cross members. Furthermore, if hit by a vehicle they tend to explode and can create considerable damage.

Attempts to solve some of these problems are evidenced by U.S. Pat. Nos. 4,183,695, Wilcox; 4,183,317, Follick; 4,231,676, Smith, et al.; 3,802,667, Kanan; 3,917,232, Lindner; 3,059,907, Trybinski, Jr.; and 1,687,820, Acker.

Each of these patents has its drawbacks as compared with the invention of applicant in that Smith, et al. does not provide good lateral stability and has a hinged joint which, through use and wear, will become loose and in effect has two cutting edges which will tend ultimately to cause deterioration of the reflective panel.

Follick's barricade is expensive, complicated, and has various movable parts.

The barricade of Wilcox is considerably more expensive than that of applicant and also, having various movable parts, is susceptible to deterioration through use.

U.S. Pat. No. 3,802,667, Kanan, and U.S. Pat. No. 3,917,232, Lindner, both have the disadvantage of moving parts which will tend to wear out in use and also suffer from lack of lateral stability.

While U.S. Pat. No. 1,687,820, Acker, and U.S. Pat. No. 3,059,907, Trybinski, Jr., both provide for legs slanting laterally to provide greater lateral stability, the upper portion of the leg portions of the barricade of Acker tend to chew into and deteriorate the panel through use as does the unit of Trybinski which is attached to the panel.

Applicant's traffic barricade is a cheap, stackable, readily assembled or disassembled unit which overcomes the various disadvantages of the prior art, is made of all welded construction, and may be readily mass produced, easily handled in the field and its design minimizes damage to the parts thereof through rough field usage It is therefore an object of this invention to provide a highway barricade which may be easily stored, and readily assembled or disassembled.

It is a further object of this invention to provide such a traffic barricade which has good lateral stability in both axes.

Additional objects and advantages of the present invention will become more readily apparently to those skilled in the art when the following general statements and descriptions are read in the light of the appended drawings.

DETAILED DESCRIPTION OF THE INVENTION

Figure 1:
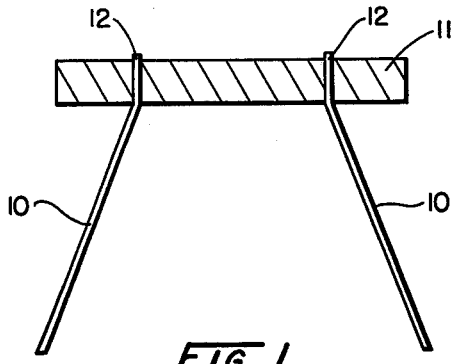
FIG. 1 is a side elevation view of the traffic barricade of the instant invention in one of its embodiments.

Referring now more particularly to FIG. 1, the leg supports 10—10 are shown holding a reflective panel 11. The upper portions 12—12 of the leg supports 10—10 are placed at an angle to the leg supports 10—10 so that when holding the reflective panel 11 the upper portions 12—12 of the leg supports 10—10 are at right angles to the length of the reflective panel 11. The lower leg portions of the leg supports 10—10 are set out at an obtuse angle to the vertical portions 12—12 in both the plane of 12—12 and the plane at right angles thereto so that lateral support along the length of reflective panel 11 is provided. The leg supports 10—10 are preferably made from round, five-eighths ($\frac{5}{8}$) inch hot-rolled steel bars. Such leg supports 10—10 are easily reshaped by a few hammer blows in case of damage from a collision by a vehicle. Reflective panel 11 may be covered with an appropriate reflective material such as Scotch Lite 580 tape cover or Scotch Lite reflective paint, thus obviating the need for battery powered lights. Reflective panel 11 may be made out of wood, #2 white pine being quite adequate.

Figure 2:
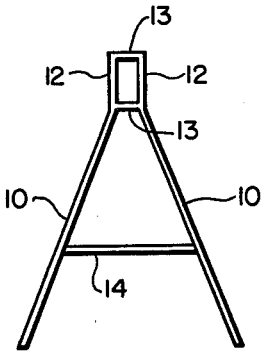
FIG. 2 is an end view of one of the leg supports shown in FIG. 1.

Referring now more particularly to FIG. 2, leg supports 10—10 and upper portions 12—12 are welded together with horizontal members 13—13. Alternatively, leg supports 10—10, upper portions 12—12, and the upper member 13 of members 13—13 may be made from a single bar which has been bent to shape. The members 13—13 are of a size so as to receive reflective panel 11 in the rectangle formed by upper portions 12—12 and 13—13. Cross member 14 is welded to each leg support 10, slightly below midway of its length, so as to provide lateral support of the leg supports 10—10 as shown in FIG. 2.

Figure 3:
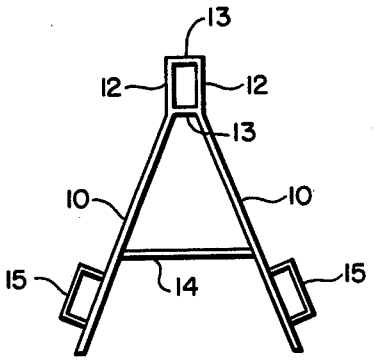
FIG. 3 is a variation of the leg support of FIG. 2.

Referring now more particularly to FIG. 3, the leg supports 10—10 shown in FIG. 2 have been modified to provide reflective panel receiving members 15—15 mounted towards the lower ends the leg supports 10—10 by welding so as to receive additional reflective panels similar to reflective panel 11. The reflective panel receiving members 15—15 may be made of lighter steel such as three-eighths ($\frac{3}{8}$) inch steel bars.

Figure 4:
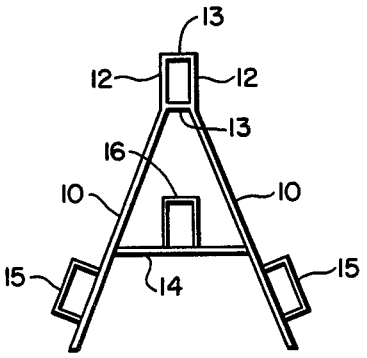
FIG. 4 is a further variation of the leg support of FIG. 2.

Referring now more particularly to FIG. 4, there is shown a leg support similar to that shown in FIG. 3 except that mounted vertically on cross member 14 is a U-shaped member 16 of a size adapted to receive an additional reflective panel similar to that of 11. This may also be made of $\frac{3}{8}$ inch steel bar and is welded to cross member 14.

In operation, a single workman can take a leg support 10, insert the reflective panel 11 therein, leave the unit sitting on the ground with the end of reflective panel 11 which is not supported by a leg support 10, supported by the ground with the other end of the reflective panel 11 angled upwardly and supported by leg support 10 and then insert the open end of reflective panel 11 in an additional leg support 10.

It will be noted that no tools are required for erection or dismantling of this invention and there are no rivets, screws, bolts, nails, or fasteners of any kind involved. One individual can easily erect this barricade. The invention also requires no maintenance.

The position of leg support 10 on reflective panel 11 may be readily adjusted. Since the upper portions 12—12 of leg supports 10—10 are at right angles to reflective panel 11, the leg supports 10—10 may be readily slid back and forth. If the modifications of leg support 10 shown in FIG. 3 and FIG. 4 are utilized, additional reflective panels may be readily inserted in the reflective panel receiving members 15—15 or U-shaped member 16 so as to provide additional reflective surfaces and also additional stability to the unit.

Because of the shape of the unit and the relatively small diameter of the bar portions from which it is constructed, it is readily stacked for transportation on a truck to the site where it is to be used and may be readily assembled or disassembled at the site. Furthermore, it may be readily carried in the trunks of emergency police vehicles. Because of the lateral support provided both crosswise of the reflective panel 11 and longitudinally of the reflective panel 11, it is not necessary to provide sandbags in order to hold the unit down in high winds. Furthermore, minimal wear of the reflective panel 11 results in assembling or disassembling because of the angular position of upper portions 12—12 of the leg supports 10—10 at right angles to the reflective panel 11.

Since the reflective panels 11—11 which are inserted in reflective panel receiving members 15—15 and U-shaped member 16 do not provide primary support, these openings may be slightly larger since they are at an angle to the positioning of the reflective panels 11—11 so as to avoid damage to the reflective panels 11—11.

While this invention has been described in its preferred embodiment, it is to be appreciated that variations therefrom may be made without departing from the true scope and spirit of the invention.

What is claimed is:

1. A collapsible traffic barricade comprising a reflective panel essentially rectangular in shape and in cross-section, the length of said panel being substantially greater than its height and the height of said panel being substantially greater than its width, two metal leg supports each comprising an upper portion, rectangular in shape and of a size slightly larger than the cross-sectional size of said panel and adapted to receive said panel therein, and being provided with two legs, each of said legs being positioned at obtuse angles to said upper portion of said leg supports both in the plane of said upper portion and in a plane at right angles to said upper portion, and a horizontal connector connecting said lower portions of said leg supports approximately midway thereof, each of said metal legs being provided on the outside of its lower portion with a rectangular member of a size adapted to receive a reflective panel therein.

2. The barricade of claim 1 wherein said horizontal connector is provided with an upstanding rectangular member of a size adapted to receive a reflective panel therein.

* * * * *